United States Patent [19]

Bowers et al.

[11] 4,060,845

[45] Nov. 29, 1977

[54] PORTABLE DEMAGNETIZER

[75] Inventors: Paul E. Bowers, Marengo; Mukund A. Phadke, Crystal Lake, both of Ill.

[73] Assignee: The Arnold Engineering Company, Marengo, Ill.

[21] Appl. No.: 670,288

[22] Filed: Mar. 25, 1976

[51] Int. Cl.[2] ..... H01F 13/00

[52] U.S. Cl. ..... 361/149

[58] Field of Search ..... 317/157.5; 335/284; 361/149, 267

[56] References Cited

U.S. PATENT DOCUMENTS

| | | | |
|---|---|---|---|
| 2,106,233 | 1/1938 | Beechlyn | 335/284 X |
| 2,826,642 | 3/1958 | Lyon et al. | 317/157.5 MR X |

FOREIGN PATENT DOCUMENTS

| | | | |
|---|---|---|---|
| 975,157 | 3/1951 | France | 335/284 |

OTHER PUBLICATIONS

The Magneraser — advertisement of Amplifier Corp. of America — 1951.

*Primary Examiner*—Harry E. Moose, Jr.

*Attorney, Agent, or Firm*—Vincent G. Gioia; Robert F. Dropkin

[57] ABSTRACT

This invention is concerned with a portable demagnetizer which includes a demagnetizing head supported within a hand held housing. Also contained within the housing is a variable control for applying voltages of decreasing step-less magnitude to the demagnetizing head; and means are also provided to apply a step-less alternating current power to the demagnetization head while voltages of decreasing magnitude are applied to the demagnetizing head. The housing is provided with a control means on the outside thereof so that the demagnetizer may be hand held and varied at the same time by a single individual user, particularly because of a minimum of parts and the use of step-less decreasing voltage magnitudes and the use of step-less alternating current power, which is applied to the demagnetizing head. Similar results can be achieved by slowly moving the work away from the alternating field.

10 Claims, 6 Drawing Figures

PORTABLE DEMAGNETIZER

BACKGROUND OF THE INVENTION

This invention relates to a portable demagnetizer, and more particularly to a demagnetizer unit particularly useful for demagnetizing a lap plate on a lapping machine or for demagnetizing punches and dies in all kinds of presses.

The invention is particularly useful in those instances where it is desired to demagnetize substances or materials which are so large and cumbersome that it is difficult and expensive to move. The principle of demagnetization is well known, and sufficient to state for the purpose of this invention that methods of demagnetization are also well known, but it is not believed to be known to provide a portable demagnetizer of sufficient strength to demagnetize the lap plate of a lapping machine.

The lap plate of a lapping machine as a result of its contact with ferromagnetic material during use as well as a result of friction between the parts to be lapped and the lap plate becomes magnetized, and as a result problems arise in the use of the lapping machine. Specifically, as a result of the magnetization of the lap plate, it becomes possible for small foreign particles to become trapped between the lap plate and work piece so that problems arise in connection with the dimensional tolerances of the work pieces, particularly, if such tolerances are critical. Heretofore, the lap plate would have to be removed from the machine and brought to a stationary demagnetizer and thereby result in delays as well as down time for the lapping machine, as well as a loss due to labor costs. Accordingly, the plate is not demagnetized as often as it should be. The same problem applies to the breakage of punches and dies in a press and to other machines which are not demagnetized as often as they should be.

The prior art is basically the non-portable demagnetizers which have been used and which require the article or element which is to be demagnetized to be brought to it. In general, it is known to the prior art to use thermal demagnetization or demagnetization by applying a D.C. field in a direction opposite to the magnetization direction. Another form of demagnetization is to apply an alternating magnetic potential and slowly reduce its amplitude to zero. As the applied potential is reduced in magnitude, the inductor follows an ever-decreasing hysteresis loop until the magnetizing force and the inductor both reach zero. Similar results can be achieved by slowly moving the work piece away from the alternating field. This form of demagnetization has not heretofore been accomplished with a portable device for demagnetizing parts as heavy as lapping plates.

SUMMARY OF THE INVENTION

An object of the invention is to provide for the demagnetization of large machine elements whereby to decrease the down time of the machine.

A further object of the invention is the provision of a demagnetizer which can be considered to be portable and readily handled so as to demagnetize the element of a machine without having to disassemble the same.

Yet another object of the invention is to provide for a demagnetizer which can be handled and controlled by a single individual, and which can operate on normal factory power while developing sufficient magnetic field to demagnetize any suitable surface.

In general, in order to accomplish the foregoing objects, the present invention proposes the use of a demagnetizing head and an adjustable power supply supported by a single hand-carrying unit. The demagnetizing head is a wire wound soft laminated core that feeds the demagnetizing flux into the plate of the lapping machine or similar device to be demagnetized. The head is energized and the amount of energy applied thereto is controlled by an adjustable voltage supply for step-less or smooth control in such a manner that the power is smoothly decreased while the head is moved to cover thoroughly the area to be demagnetized. With the present invention, one individual can simultaneously operate the power supply while moving the head over the area to the demagnetized.

It should be understood that the lap plate of lapping machines is a cumbersome item and cannot be handled by a single individual. For example, the typical weight of a lap plate is about 700 pounds, and it takes about 2 days down time as well as lost labor and lost use of the machine in order to remove the plate from the machine, and take it to a stationary demagnetizer at the manufacturer's plant and return it and reassemble the machine.

With the present invention, it is possible to demagnetize a lap plate of the type heretofore described in a period of approximately 30 minutes so that the savings in cost becomes obvious. Moreover, the important factor of avoiding a considerable amount of down time of a machine is considerably reduced.

Other objects, features and advantages of the invention will become apparent from the following description and claims and illustrated in the accompanying drawing, which discloses, by way of example, the principles of the invention and the best modes which have been contemplated for carrying them out.

Figure 1:
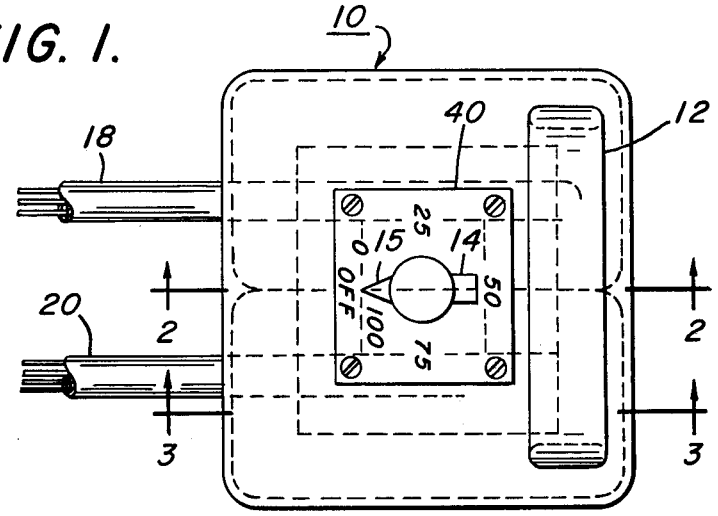
FIG. 1 is a top plan view of a portable demagnetizer in accordance with the invention.

Referring now to the drawing and more particularly to FIG. 1, in which the portable demagnetizer is shown in accordance with the principles of the invention, and includes a housing 10 with a handle 12 attached to the top, a switch and voltage magnitude control 14, a three wire conventional 115 volts, 60 Hertz supply cord 18 and a power control cord 20.

Figure 2:
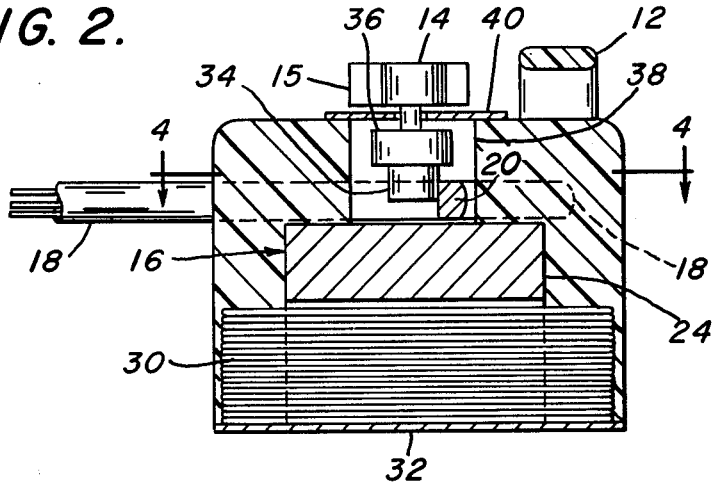
FIG. 2 is a sectional view taken along lines 2—2 of FIG. 1.
Figure 3:
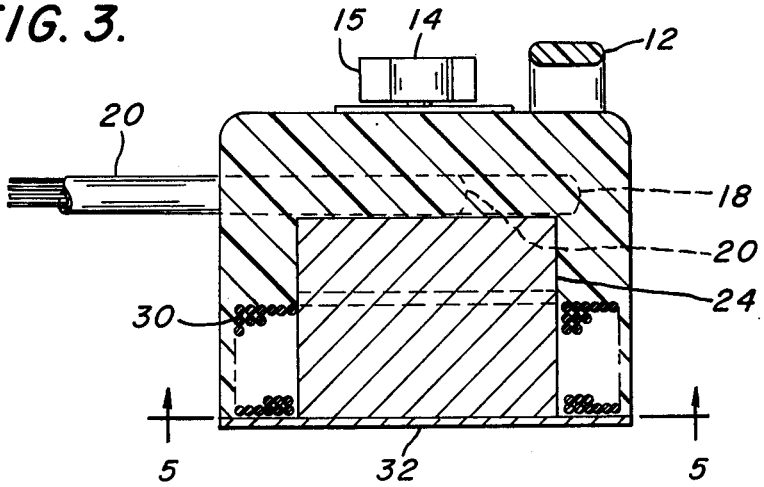
FIG. 3 is a sectional view taken along lines 3—3 of FIG. 1.
Figure 4:
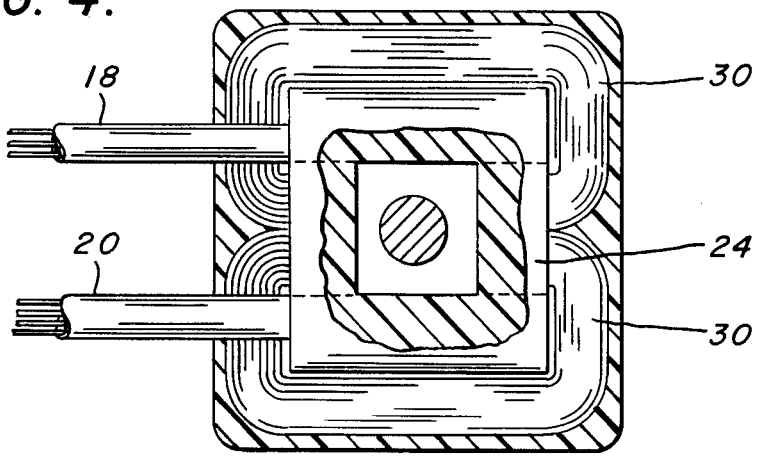
FIG. 4 is a sectional view taken along lines 4—4 of FIG. 2 looking down into the top of the laminated core.
Figure 5:
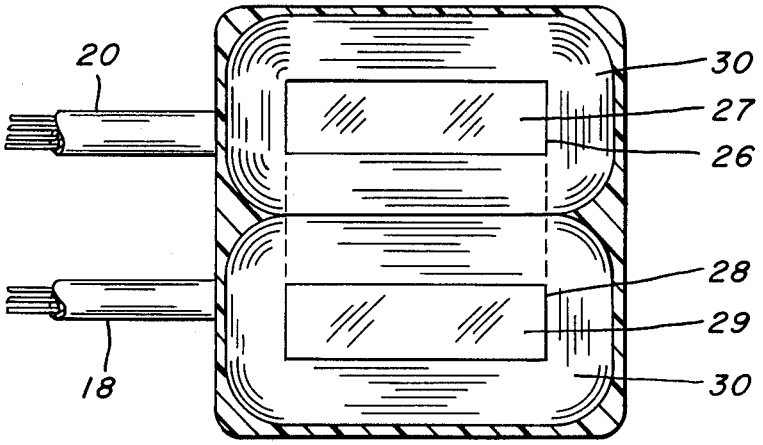
FIG. 5 is a sectional view taken along lines 5—5 of FIG. 3, showing the legs of the laminated core exposed with the coil wound thereabout; and, FIG. 6 is a perspective diagramatic view of the laminated core with wire wound thereabout and positioned on the lap plate of a lapping machine and showing the lines of demagnetization flux for demagnetizing the lap plate.

As best seen in FIGS. 2 and 3, all of the elements necessary to be brought to a lap plate 22 (FIG. 6) or any other magnetic media on a machine for demagnetization of the same are contained within the housing 10, and elements are arranged such that control and use may be exercised by a single operator. Contained within the housing 10 is a demagnetizing head 16 which includes a magnetic core 24 having a pair of legs 26, 28 with core faces 27, 29, (FIG. 5) with coils 30 suitably and conventionally wound thereabout. At the bottom of the housing 10, there is provided a non-magnetic wear plate 32 to provide for a complete enclosure to maintain the inside of the housing substantially dust-free while at the same time not intefering with the operation of the demagnetizer; the wear plate 32 covers up the core faces 27 and 29 of the legs 26 and 28, yet does not interfere with them magnetically.

The voltage magnitude control 14 includes a hand control knob 15 and a control switch 34 connected with the power control cord 20 in order to control the magnitude of the voltage applied to the coil 30 so that the magnitude may be varied in a step-less fashion with different magnitudes between its maximum of 120 volts A.C. down to zero. A variable power control is provided which includes a control potentiometer 36 positioned with the control switch 34 within a control potentiometer cavity or housing 38. A cover plate 40 is provided for housing 38 and carries indices marked thereon of 25, 50, 75 and 100, and these are voltage magnitudes. The cover plate 40 is provided to assure easy access to the control switch or control potentiometer should some adjustment be necessary. The control potentiometer 36 is connected with the control cord 20 for connection thereof to a control panel which includes a step-less A.C. power control which may be 100 feet away from the housing 10.

The control potentiometer 36 is connected with the step-less A.C. power control of the type which is capable of providing smooth step-less A.C. power control without the use of sliding contacts or moving parts, and the output voltage is unaffected by variations in load. A typical step-less power control which may be used is obtainable from Payne Engineering Company of South Charleston, W. Va., and is designated Power Control, Model 18D.

Figure 6:
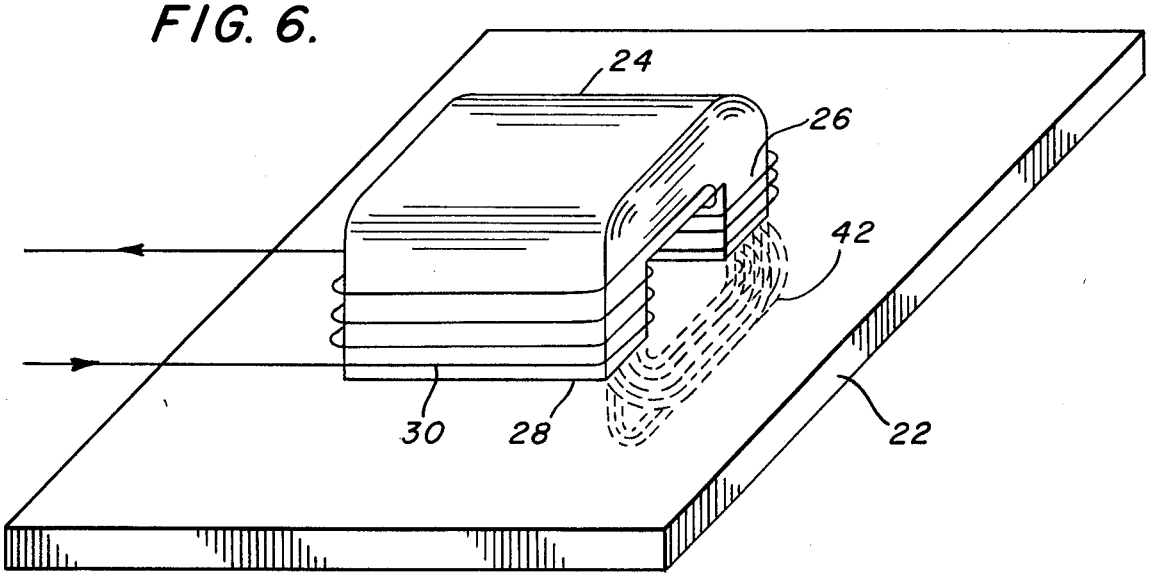

Referring now more particularly to FIG. 6, the magnetic core 24 is typically a laminated soft magnetic iron core structure, and coils 30 are typically insulated copper wire for creating the magnetic field through the core. The laminated core which has been found suitable for use in the hand-held portable demagnetizer is a 12 mill laminated core and has a measurement of 1 inch by $3\frac{3}{8}$ inches cross section and a window area measuring $1\frac{7}{8}$ inches in height by $2\frac{1}{8}$ inches in width by $3\frac{3}{8}$ inches in length. The coils are wound so as not to overload the supplies, and yet are suitable to obtain sufficient field to demagnetize the surface conditions under consideration. As noted from the size of the core 24 and the winding area in the window area, the demagnetizer is of small dimension and easily held in the hand of the user who has the other hand free to adjust the voltage magnitude between a range of 0 to 120 volts.

Demagnetization takes place as a result of a variation of the voltage applied to the core in a step-less manner from a high value, such as the maximum from the power supplied through supply cord 18 to a minumum or a zero value, while at the same time reducing the amplitude of the field by reducing the power uniformly and continuously. The housing 10 which is held by means of handle 12 is used to move the legs 26, 28 which is covered by the non-magnetic wear plate 32 over the entire area of the lap plate 22 or other magnetic media on the machine which is to be demagnetized. Wear plate 32 maintaines core faces 27, 29 out of physical contact with the lap plate 22 but permits magnetic contact therewith for demagnetization thereof. The power is turned down slowly by means of control 14 while moving the legs 26, 28 of the demagnetizing head 16. The operator or user will use one hand to hold the handle 12 and the other hand to adjust the control 14 to operate the power supplied to the coils 30.

As is well known, as the applied potential is reduced in magnitude, the inductor and the magnetizing force in the lap plate or other magnetic media on the machine follows an ever-decreasing hysteresis loop until the magnetizing force in the lap plate and the inductor both reach zero.

While reference was made to the step-less A.C. power control which uses a solid state controlled SCR, it is also possible to use a 60 Hertz variable autotransformer to supply the variable voltage and current to the coils 30. What is important is that means be provided to supply A.C. power to the coils 30 and smoothly reduce the same for different voltage magnitudes, and to reduce the voltage magnitudes so as to decrease and bring down the magnetization of the lap plate 22 or other magnetic media on the machine which is to be demagnetized to acceptable usable levels which will not interfere with the use of the lap plate.

While there has been described what is considered to be a preferred embodiment, it will be evident that many changes and modifications may be made without departing from the spirit and scope of the present invention.

We claim:

1. A portable demagnetizer comprising a housing, a demagnetizing head in said housing including at least one coil, means for supplying an alternating current potential to said coil, means for varying the magnitude of said alternating current potential from a maximum of the supplied potential to a predetermined minimum whereby to reduce the magnitude of the voltage potential applied to said demagnetization head and thereby reduce the magnitude of the magnetic field of said demagnetization head, and a control circuit for operating said varying means to apply a step-less alternating current power to aid demagnetization head for each variation of said varying means, said control circuit including a power control cord leading to said housing and means supported by said housing for operating said control circuit.

2. A demagnetizer according to claim 1 in which said means for operating said control circuit includes a cavity in said housing extending to the top thereof, a control knob located outside of said housing adjacent said cavity, a control shaft operated by said knob extending into said cavity, and a control potentiometer in said control circuit positioned in said cavity and operable by said control shaft.

3. A demagnetizer according to claim 2 including a switch for said control circuit in said cavity operable by said control shaft.

4. A demagnetizer according to claim 1, wherein said demagnetization head includes a U-shaped core element having a pair of leg portions for supplying demagnetization flux, and coils wound on each of said leg portions and connected with said alternating current supply means.

5. A demagnetizer according to claim 4 in which said means for operating said control circuit includes a cavity in said housing extending to the top thereof, a control knob located outside of said housing adjacent said cavity, a control shaft operated by said knob extending into said cavity, and a control potentiometer in said control circuit positioned in said cavity and operable by said control shaft.

6. A demagnetizer according to claim 5 including a switch for said control circuit in said cavity operable by said control shaft.

7. A demagnetizer according to claim 2 wherein said housing includes a cavity in said housing extending to the bottom thereof, and wherein said demagnetization head includes a U-shaped core element having a pair of leg portions for supplying demagnetizing flux with the free ends of said leg portions positioned adjacent the bottom of said housing and coils wound on each of said leg portions connected with said alternating supply means.

8. A demagnetizer according to claim 7 including a handle connected to said housing adapted for carrying thereof, a non-magnetic wear plate secured to the bottom of said housing and closing said bottom cavity, and means secured to the top of said housing and closing said top cavity.

9. A demagnetizer according to claim 8 including a switch for said control circuit in said top cavity operable by said control shaft, and wherein said means for varying the magnitude of said alternating current potential is located external of said housing and is free of moving parts.

10. A demagnetizer according to claim 1 wherein said means for varying the magnitude of said alternating current potential is of the class consisting of a solid state controlled SCR and a 60 Hertz variable autotransformer.

* * * * *